US009932200B2

(12) United States Patent
Chen

(10) Patent No.: US 9,932,200 B2
(45) **Date of Patent: *Apr. 3, 2018**

(54) PORTABLE STRAP DISPENSER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 164 days.

This patent is subject to a terminal disclaimer.

(21) Appl. No.: 14/993,915

(22) Filed: Jan. 12, 2016

(65) Prior Publication Data

US 2017/0197802 A1 Jul. 13, 2017

(51) Int. Cl.
*B65H 59/16* (2006.01)
*B65H 75/18* (2006.01)
*B65H 75/30* (2006.01)

(52) U.S. Cl.
CPC ..... *B65H 59/16* (2013.01); *B65H 75/185* (2013.01); *B65H 75/30* (2013.01)

(58) Field of Classification Search
CPC ..... B65H 59/16; B65H 75/30; B65H 75/185
See application file for complete search history.

(56) References Cited

U.S. PATENT DOCUMENTS 2,506,354 A * 5/1950 Green ..... B21C 47/34 242/286
3,222,008 A * 12/1965 Purzycki ..... B21C 47/18 242/420.4
3,602,452 A * 8/1971 Sauer ..... B65H 23/08 242/156
3,826,443 A * 7/1974 Goodley ..... B65B 13/18 242/421.9
2017/0203937 A1* 7/2017 Yu Chen ..... B65H 59/16

* cited by examiner

*Primary Examiner* — Sang K Kim
(74) *Attorney, Agent, or Firm* — Ming Chow; Sinorica, LLC

(57) ABSTRACT

A portable strap dispenser includes a main body. The main body has a first frame and a second frame which are symmetrically disposed. A fixing sleeve is provided at the joint of the first frame and the second frame. The portable strap dispenser further includes a strap disc. The strap disc is provided with a pivot penetrating through the strap disc. Two ends of the pivot are pivoted to the first frame and the second frame, respectively. The first frame is pivotally provided with a brake device. During transportation, the portable strap dispenser can be disassembled to reduce its size so as to increase cargo capacity and lower transportation cost.

7 Claims, 5 Drawing Sheets

PORTABLE STRAP DISPENSER

BACKGROUND OF THE INVENTION

1. Field of the Invention

The present invention relates to a strap dispenser, and more particularly to a portable strap dispenser which can be assembled and disassembled.

2. Description of the Prior Art

A conventional strap dispenser comprises a frame. The frame is provided with a shaft. The shaft is inserted through a strap disc to be positioned. The strap disc has an inner disc and an outer disc. A packing strap is provided between the inner disc and the outer disc after the shaft is positioned. The strap disc is provided with a brake rod. One end of the brake rod is pivotally connected to the frame. Another end of the brake rod is bent transversely towards the outer circumferential edge of the inner disc. The brake rod is provided with a brake block at the bent position corresponding to the outer circumferential edge of the inner disc. The distal end of the brake rod is provided with a strap clip seat. When in use, the packing strap between the inner disc and the outer disc is pulled out. When not in use, the brake block holds against the inner disc to stop turning of the inner disc, such that the packing strap won't be further pulled out. The structure is simple and convenient for operation.

However, the strap dispenser is large in size to occupy much space during transportation. This decreases cargo capacity and increases transportation cost. Accordingly, the inventor of the present invention has devoted himself based on his many years of practical experiences to solve these problems.

SUMMARY OF THE INVENTION

The primary object of the present invention is to provide a portable strap dispenser which can be assembled and disassembled to reduce its size during transportation so as to lower transportation cost.

In order to achieve the aforesaid object, the portable strap dispenser of the present invention comprises a main body, a strap disc, and a brake device. The main body has a first frame and a second frame which are symmetrically disposed. The first frame and the second frame have a first coupling member and a second coupling member, respectively. The main body further has a fixing sleeve. Two ends of the fixing sleeve are connected with the first coupling member and the second coupling member, respectively. Each of the first frame and the second frame is provided with a pivot member. The strap disc is disposed between the first frame and the second frame. The strap disc is provided with a pivot penetrating through the strap disc. Two ends of the pivot are pivoted to the pivot members of the first frame and the second frame, respectively. The brake device comprises a rod member. A first end of the rod member is pivotally connected to the first frame. A second end of the rod member selectively leans against the strap disc.

Thereby, the first coupling member of the first frame and the second coupling member of the second frame are connected with each other; the fixing member is fitted on the first coupling member and the second coupling member; the two ends of the pivot of the strap disc are pivotally connected to the pivot members; and the brake device is pivotally connected to the first frame to complete the assembly of the portable strap dispenser. During transportation, the portable strap dispenser can be disassembled to reduce its size so as to increase cargo capacity and lower transportation cost.

DETAILED DESCRIPTION OF THE PREFERRED EMBODIMENTS

Embodiments of the present invention will now be described, by way of example only, with reference to the accompanying drawings.

Figure 1:
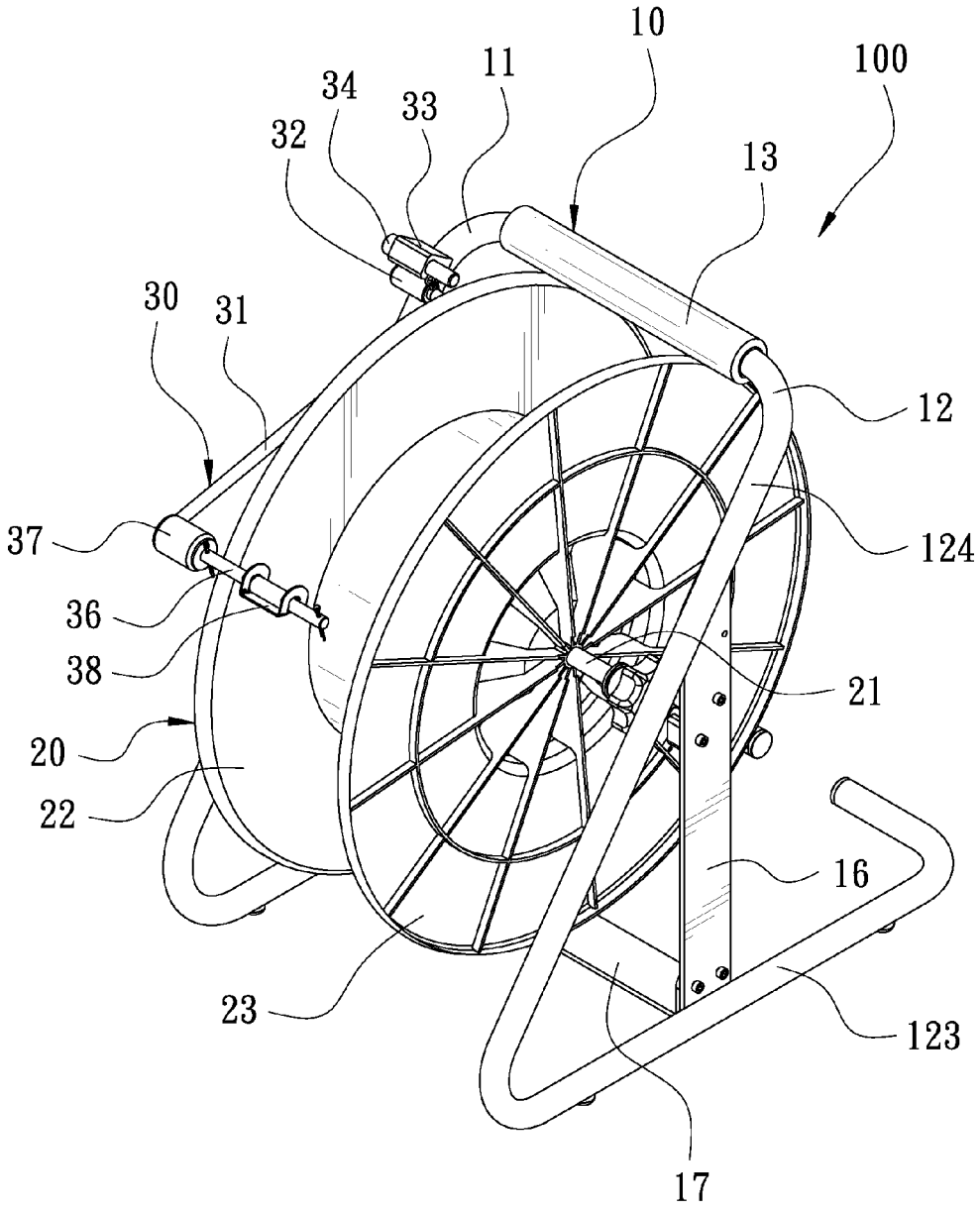
FIG. 1 is a perspective view of the present invention.
Figure 2:
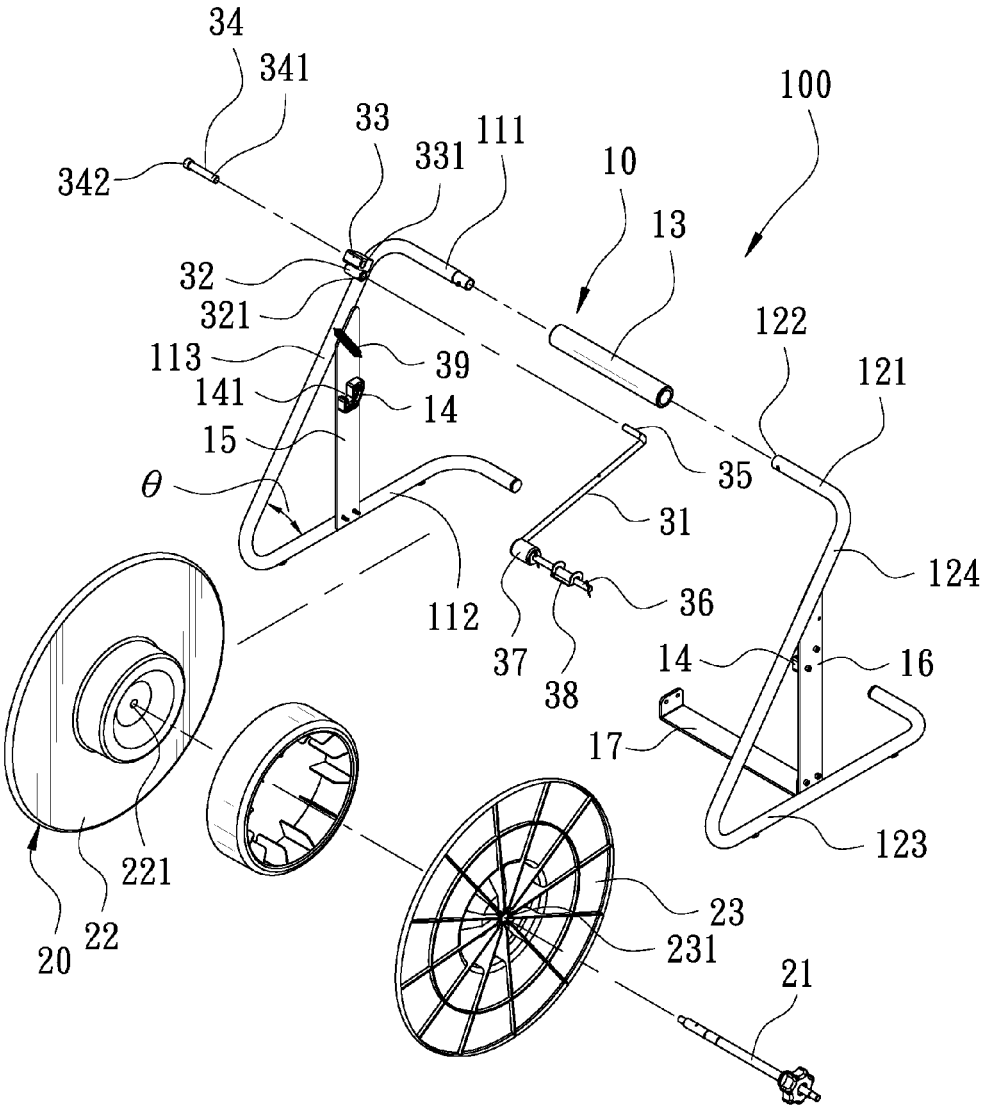
FIG. 2 is an exploded view of the present invention.
Figure 3:
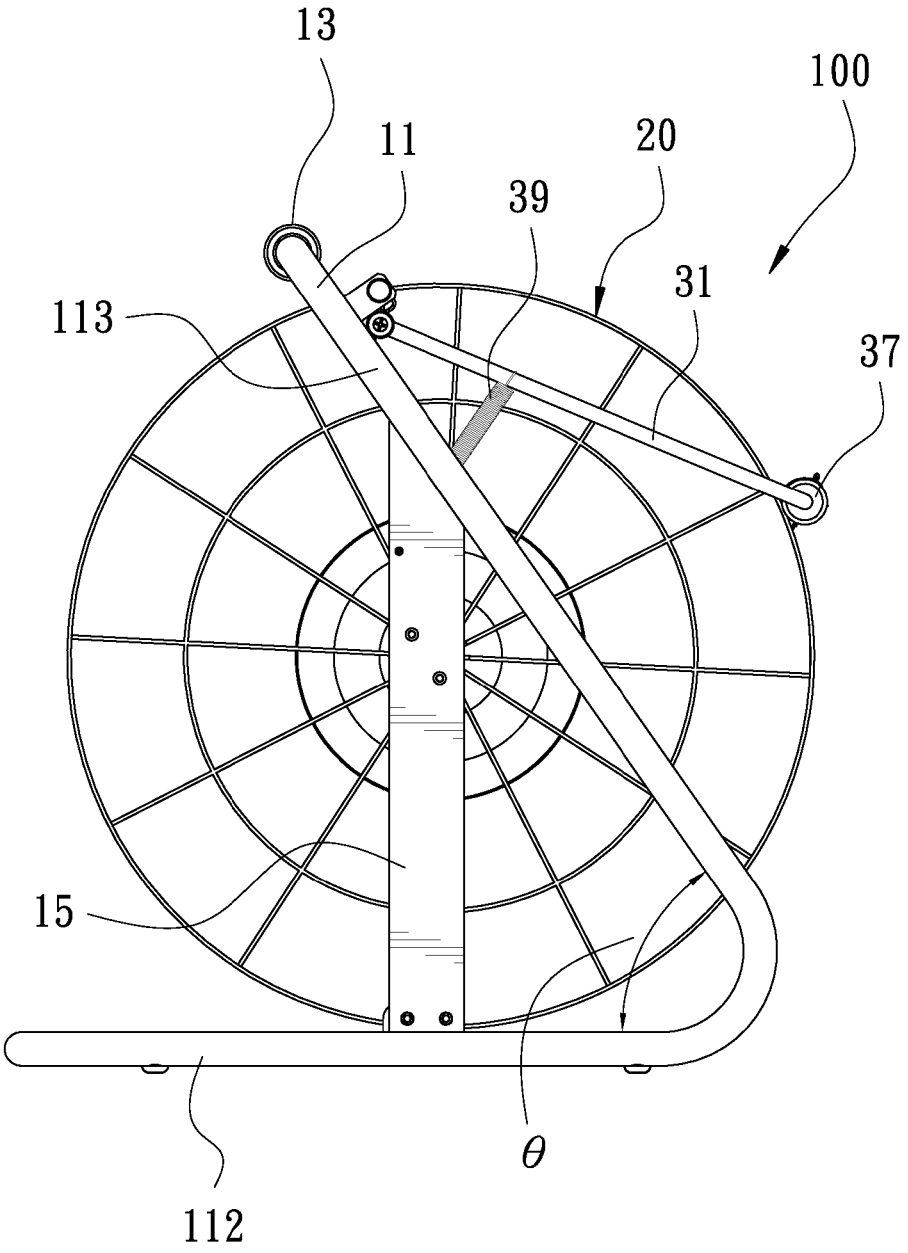
FIG. 3 is a side view of the present invention.

FIG. 1 is a perspective view of the present invention. FIG. 2 is an exploded view of the present invention. FIG. 3 is a side view of the present invention. The present invention discloses a portable strap dispenser 100. The portable strap dispenser 100 comprises a main body 10, a strap disc 20, and a brake device 30.

The main body 10 has a first frame 11 and a second frame 12 which are symmetrically disposed. The first frame 11 and the second frame 12 have a first coupling member 111 and a second coupling member 121, respectively. The main body 10 further has a fixing sleeve 13. Two ends of the fixing sleeve 13 are connected with the first coupling member 111 and the second coupling member 121, respectively. In this embodiment of the present invention, the first coupling member 111 and the second coupling member 121 are connecting rods. The second coupling member 121 is formed with a coupling hole 122 corresponding to the first coupling member 111. The coupling hole 122 has a diameter slightly greater than an outer diameter of the first coupling member 111 for the coupling hole 122 to receive the first coupling member 111. Each of the first frame 11 and the second frame 12 is provided with a pivot member 14. In this embodiment of the present invention, the first frame 11 has a first transverse rod 112. The first transverse rod 112 is connected with a first connecting rod 113. An angle θ is defined between the first transverse rod 112 and the first connecting rod 113. The angle θ is an acute angle. A free end of the first connecting rod 113 is connected with the first coupling member 111. The first coupling member 111 is disposed towards the second frame 12. The first frame 11 is longitudinally provided with a first fixing board 15. Two ends of the first fixing board 15 are connected with the first transverse rod 112 and the first connecting rod 113, respectively. The second frame 12 has a second transverse rod 123 corresponding to the first transverse rod 112 of the first frame 11, a second connecting rod 124 corresponding to the first connecting rod 113, the second coupling member 121 corresponding to the first coupling member 111, and a second fixing board 16 corresponding to the first fixing board 15. A third fixing board 17 is provided and transversely connected between the first fixing board 15 and the second fixing board 16. Each of the first fixing board 15 and the second fixing board 16 is provided with the pivot member 14. A top side of the pivot member 14 is formed with a pivot groove 141.

The strap disc 20 is disposed between the first frame 11 and the second frame 12. The strap disc 20 is provided with a pivot 21 penetrating through the strap disc 20. Two ends of the pivot 21 are pivoted to the pivot members 14 of the first frame 11 and the second frame 12, respectively. In this embodiment of the present invention, the strap disc 20 has a first disc 22 and a second disc 23. The first disc 22 is formed with a central first pivot hole 221 and the second disc 23 is formed with a central second pivot hole 231 for the pivot 21 to pass therethrough.

The brake device 30 comprises a rod member 31. A first end of the rod member 31 is pivotally connected to the first frame 11. A second end of the rod member 31 selectively leans against the strap disc 20. In this embodiment of the present invention, the brake device 30 comprises a block member 32. The block member 32 is disposed on the first connecting rod 113. The block member 32 is formed with a through hole 321. One side of the block member 32, close to the first coupling member 111, is provided with a stop block 33. The stop block 33 is formed with a slide hole 331 parallel to the through hole 321. A body portion 341 of a stop rod 34 is slidably provided in the slide hole 331. One end of the stop rod 34, opposite the strap disc 20, is provided with an enlarged head portion 342. The first end of the rod member 31 is provided with a turning rod 35 towards the first frame 11. The turning rod 35 is pivotally connected to the through hole 321. The second end of the rod member 31 is provided with a brake rod 36 parallel to the pivot 21. A brake roller 37 is fitted on the brake rod 36. The brake roller 37 selectively leans against the first disc 22. The brake rod 36 is provided with a strap clip seat 38. Furthermore, the brake device 30 further comprises an extension spring 39. One end of the extension spring 39 is hooked to the rod member 31, and another end of the extension spring 39 is hooked to the first connecting rod 113.

The structural features, technical means of use, and expected effects of the present invention are described hereinafter.

FIG. 2 is an exploded view of the present invention. To assemble the portable strap dispenser 100, the first fixing board 15 and the second fixing board 16 are first screwed to the first frame 11 and the second frame 12, respectively. The first coupling member 111 is inserted through the fixing sleeve 13 and coupled to the coupling hole 122 of the second coupling member 121, and then the first coupling member 111 and the second coupling member 121 are connected with each other. Two ends of the third fixing board 17 are screwed to the first fixing board 15 and the second fixing board 16, respectively. The brake device 30 is pivotally connected to the first frame 11. A packing strap 200 is mounted between the first disc 22 and the second disc 23. Two ends of the pivot 21 of the strap disc 20 are pivotally connected to the pivot grooves 141 of the pivot members 14, such that the assembly of the present invention is completed for packing work.

Figure 4:
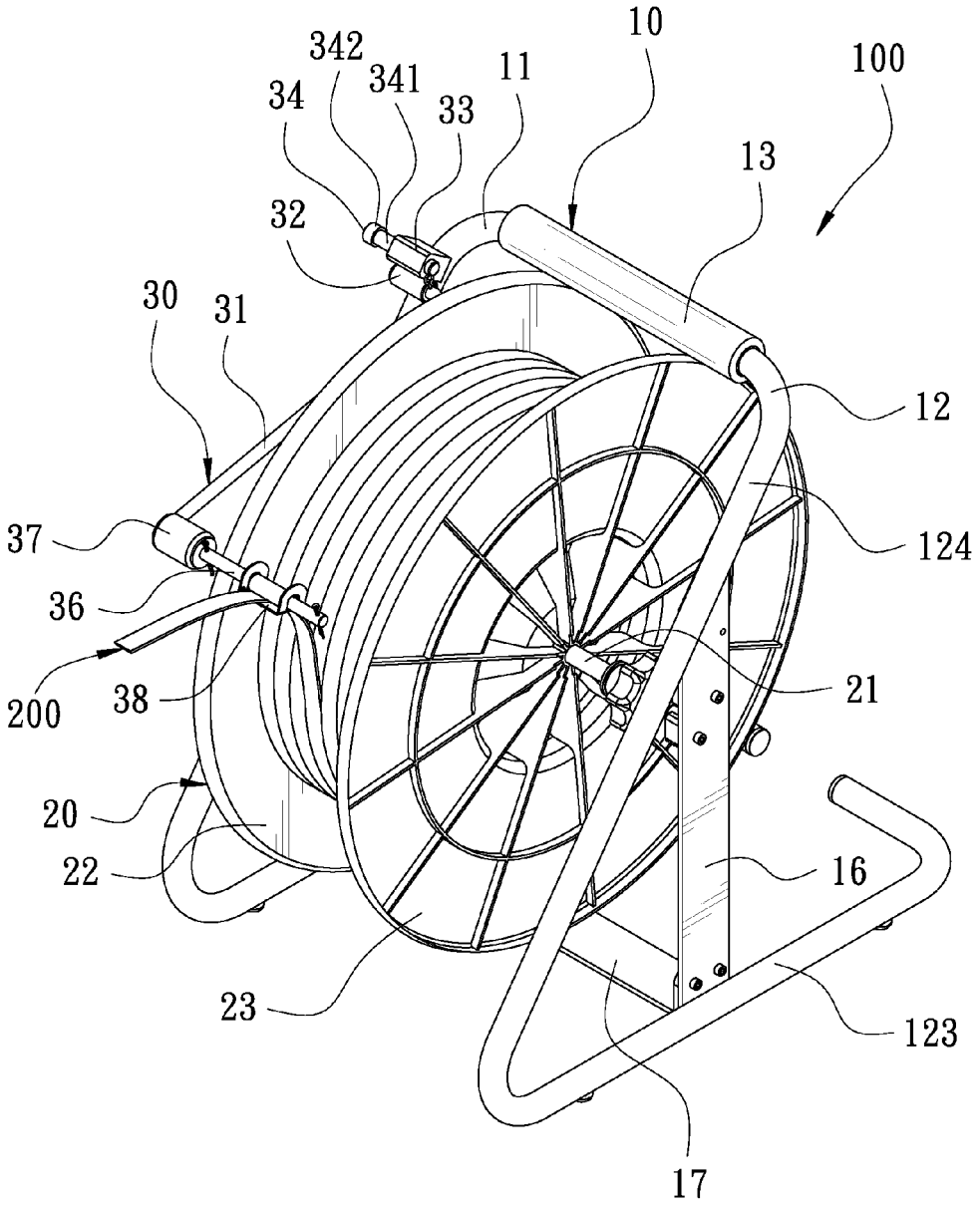
FIG. 4 is a schematic view of the present invention when in use.
Figure 5:
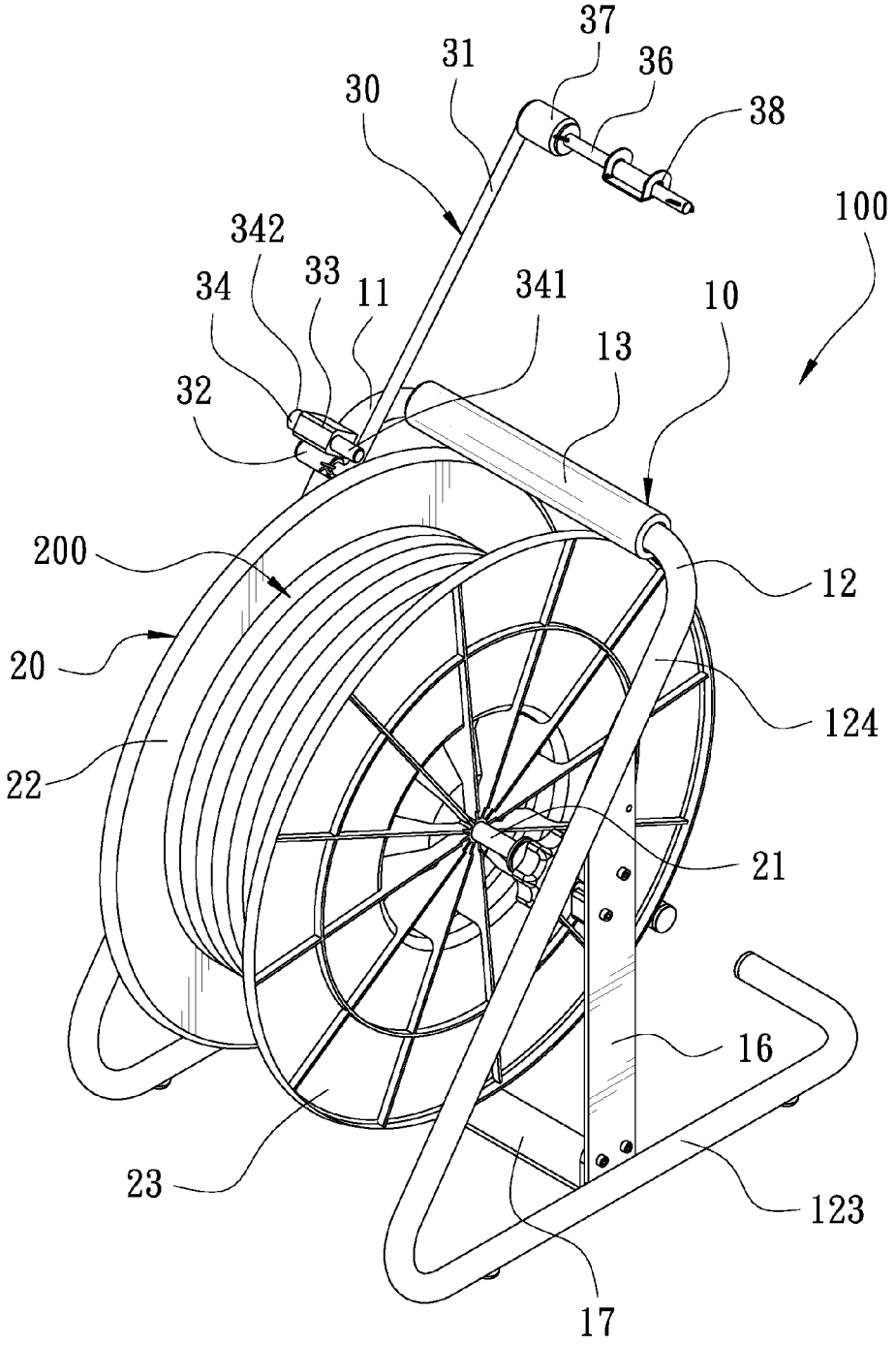
FIG. 5 is a schematic view of the present invention when in use, showing replacement of a strap disc.

FIG. 4 is a schematic view of the present invention when in use. When the user wants to use the portable strap dispenser 100, the body portion 341 of the stop rod 34 is retracted in the slide hole 331. The packing strap 200 is pulled out from the strap clip seat 38. The strap disc 20 is turned along with movement of the packing strap 200 for the user to implement packing work. When the user wants to replace the packing strap 200, as shown in FIG. 5, the brake rod 36 is turned towards the first coupling member 111. The rod member 31 can lean against the first frame 11 through the angle θ which is an acute angle. The body portion 341 of the stop rod 34 is pushed out to limit and position the rod member 31. Through the technical feature that the main body 10 has the angle θ which is an acute angle, the strap disc 20 can be lifted for replacement of the packing strap 200.

Thereby, the first coupling member 111 of the first frame 11 and the second coupling member 121 of the second frame 12 are connected with each other; the fixing member 13 is fitted on the first coupling member 111 and the second coupling member 121; the two ends of the pivot 21 of the strap disc 20 are pivotally connected to the pivot members 14; and the brake device 30 is pivotally connected to the first frame 11 to complete the assembly of the portable strap dispenser 100. During transportation, the portable strap dispenser can be disassembled to reduce its size so as to increase cargo capacity and lower transportation cost.

It is noted that when the user wants to stop using the portable strap dispenser 100, the brake rod 36 is turned reversely relative to the first coupling member 111 for the brake roller 37 to hold against the first disc 22 to stop turning of the first disc 22, providing a brake effect. The brake device 30 is biased and limited by the extension spring 39. When the distal end of the packing strap 200 is cut or released, the rod member 31 is pulled back by the extension spring 39 and the brake roller 37 is against the first disc 22, enabling the first disc 22 as well as the second disc 23 to stop turning.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A portable strap dispenser, comprising:

a main body, the main body having a first frame and a second frame which are symmetrically disposed, the first frame and the second frame having a first coupling member and a second coupling member respectively, the main body further having a fixing sleeve, two ends of the fixing sleeve being connected with the first coupling member and the second coupling member respectively, each of the first frame and the second frame being provided with a pivot member;

a strap disc, the strap disc being disposed between the first frame and the second frame, the strap disc being provided with a pivot penetrating through the strap disc, two ends of the pivot being pivoted to the pivot members of the first frame and the second frame respectively;

a brake device, the brake device comprising a rod member, a first end of the rod member being pivotally connected to the first frame, a second end of the rod member selectively leaning against the strap disc;

the strap disc has a first disc and a second disc, and each of the first disc and the second disc is formed with a central pivot hole for the pivot to pass therethrough; and the brake device comprises a block member, the block member is disposed on the first connecting rod, the block member is formed with a through hole, the first end of the rod member is provided with a turning rod towards the first frame, the turning rod is pivotally connected to the through hole, the second end of the rod member is provided with a brake rod parallel to the pivot, a brake roller is fitted on the brake rod, the brake roller selectively leans against the first disc, and the brake rod is provided with a strap clip seat.

2. The portable strap dispenser as claimed in claim 1, wherein the first frame has a first transverse rod, the first transverse rod is connected with a first connecting rod, a free end of the first connecting rod is connected with the first coupling member, the first coupling member is disposed towards the second frame, the first frame is longitudinally provided with a first fixing board, two ends of the first fixing board are connected with the first transverse rod and the first connecting rod respectively, and the second frame has a second transverse rod corresponding to the first transverse rod of the first frame, a second connecting rod corresponding to the first connecting rod, the second coupling member corresponding to the first coupling member, and a second fixing board corresponding to the first fixing board.

3. The portable strap dispenser as claimed in claim 2, wherein an angle is defined between the first transverse rod and the first connecting rod, and the angle is an acute angle.

4. The portable strap dispenser as claimed in claim 2, wherein a third fixing board is provided and transversely connected between the first fixing board and the second fixing board.

5. The portable strap dispenser as claimed in claim 2, wherein each of the first fixing board and the second fixing board is provided with the pivot member facing the strap disc, and a top side of the pivot member is formed with a pivot groove for the two ends of the pivot to be pivoted therein.

6. The portable strap dispenser as claimed in claim 1, wherein the second coupling member is formed with a coupling hole corresponding to the first coupling member, and the coupling hole has a diameter slightly greater than an outer diameter of the first coupling member for the coupling hole to receive the first coupling member.

7. The portable strap dispenser as claimed in claim 1, wherein one side of the block member, close to the first coupling member, is provided with a stop block, the stop block is formed with a slide hole parallel to the through hole, a body portion of a stop rod is slidably provided in the slide hole, and one end of the stop rod, opposite the strap disc, is provided with an enlarged head portion.

* * * * *